US008356805B2

(12) United States Patent
Hänssler et al.

(10) Patent No.: US 8,356,805 B2
(45) Date of Patent: Jan. 22, 2013

(54) CARBURETOR FOR AN INTERNAL COMBUSTION ENGINE

(75) Inventors: Sebastian Hänssler, Mannheim (DE); Stefan Kummermehr, Berglen (DE); Stefan Borchert, Liederbach (DE); Alexander Kraus, Bad Ditzenbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 475 days.

(21) Appl. No.: 12/727,277

(22) Filed: Mar. 19, 2010

(65) Prior Publication Data

US 2010/0283161 A1 Nov. 11, 2010

(30) Foreign Application Priority Data

Mar. 21, 2009 (DE) ..... 10 2009 014 362

(51) Int. Cl.
*F02M 1/02* (2006.01)

(52) U.S. Cl. ..... 261/52

(58) Field of Classification Search ..... 261/52, 261/64.1, 65
See application file for complete search history.

(56) References Cited

U.S. PATENT DOCUMENTS 3,328,010 A * 6/1967 Urich et al. ..... 261/34.2
3,575,385 A * 4/1971 Szwargulski et al. ..... 261/23.2
3,807,709 A * 4/1974 Suda et al. ..... 261/39.2
4,961,409 A * 10/1990 Kobayashi et al. ..... 123/376
4,983,330 A * 1/1991 Harbeke ..... 261/52
5,500,159 A * 3/1996 Martinsson ..... 261/52
6,000,683 A 12/1999 Van Allen
6,202,989 B1 * 3/2001 Pattullo ..... 261/52
6,494,439 B1 * 12/2002 Collins ..... 261/52
6,550,749 B2 4/2003 Vick
6,848,405 B1 * 2/2005 Dow et al. ..... 123/179.18
6,896,245 B2 * 5/2005 Suzuki et al. ..... 261/23.2
7,104,527 B2 * 9/2006 Koizumi ..... 261/52
7,144,000 B2 * 12/2006 Roth et al. ..... 261/39.3
7,699,294 B2 * 4/2010 Pattullo ..... 261/52
2001/0013664 A1 * 8/2001 Kobayashi ..... 261/52
2003/0052422 A1 * 3/2003 Schliemann ..... 261/52
2007/0240892 A1 10/2007 Brotto et al.

FOREIGN PATENT DOCUMENTS

JP 59-155544 A * 9/1984

* cited by examiner

*Primary Examiner* — Richard L Chiesa
(74) *Attorney, Agent, or Firm* — Gudrun E. Huckett

(57) ABSTRACT

A carburetor for an internal combustion engine has a carburetor housing and a mixture forming passage provided in the carburetor housing. A throttle and a choke valve are rotatably arranged in the mixture forming passage on a throttle shaft and a choke shaft, respectively. A lever arrangement has a throttle adjusting lever mounted on the throttle shaft and a choke adjusting lever mounted on the choke shaft. The throttle valve and the choke valve are adjustable in several operating positions and the lever arrangement assumes appropriate positions corresponding to the operational positions, respectively. A release device for releasing a locking action between the throttle adjusting lever and the choke adjusting lever when an emergency stop is actuated is provided. A spring forcing the choke adjusting lever in a direction toward an engagement plane with the throttle adjusting lever.

15 Claims, 10 Drawing Sheets

CARBURETOR FOR AN INTERNAL COMBUSTION ENGINE

BACKGROUND OF THE INVENTION

The invention relates to a carburetor for an internal combustion engine comprising a mixture forming passage formed in a carburetor housing in which passage a throttle valve and a choke valve are rotatably supported. A lever arrangement is provided that comprises a throttle adjusting lever attached to the throttle shaft and a choke adjusting lever attached to the choke shaft, wherein the throttle valve and the choke valve are adjustable in several operating positions and the lever arrangement assumes corresponding positions.

U.S. Pat. No. 6,550,749 discloses a carburetor for an internal combustion engine of a motor-operated hand-held power tool. The carburetor comprises a throttle valve and a choke valve. For adjusting the throttle valve and the choke valve in interdependent positions as a function of several operating positions such as idle position, cold start position, and warm start position, a switch is provided that is arranged directly on the carburetor and is connected to the choke valve. In this connection, the choke valve and the throttle valve are mechanically coupled with another in such a way that the switch in each of the operating positions assumes a different position. Upon rotation of the switch, an intermediate plate that is supported on the choke shaft is rotated and locks in a predetermined position at the throttle lever.

U.S. Pat. No. 6,000,683 discloses a carburetor for small internal combustion engines that comprises a throttle valve and a choke valve wherein pretensioning means are provided that tension the throttle valve and the choke valve in the direction toward defined positions. A locking device between both valves is provided that secures the two flaps in their starting positions against the action of the pretensioning means. The locking device is releasable by a movement of the throttle valve away from its starting position and comprises a choke lever and a correlated intermediate lever that can be brought into locking engagement with one another. The locking action is released when an operator actuates an accelerator in order to accelerate the engine because the throttle lever is pivoted and releases the intermediate lever.

In the known arrangements release of the locking device is possible only upon actuation of the accelerator while in all other adjusted positions of the operating elements the locking action between throttle valve and intermediate lever remains intact.

SUMMARY OF THE INVENTION

It is an object of the present invention to provide a carburetor of the aforementioned kind in which an operating switch for different operating positions also includes an emergency stop position in which, upon emergency release, the locking action between the throttle adjusting lever and the choke adjusting lever is released.

In accordance with the present invention, this is achieved in that a release device for releasing engagement between the throttle adjusting lever and the choke adjusting lever in case of emergency stop activation is provided and a spring is present that forces the choke adjusting lever in the direction of an engagement plane with the throttle adjusting lever.

By means of the present invention, it is provided that the lever provided on the carburetor and correlated with the choke valve and also the choke valve itself are moved into a basic position from which position a new actuating process can be realized. When the emergency stop is not actuated, the release kinematics has no effect on the lever kinematics of throttle valve and choke valve.

According to a preferred embodiment of the invention, the choke adjusting lever is connected fixedly to the choke shaft and the spring loads the choke valve additionally in the direction of an open position. In this way, the number of components can be reduced. The release device on the choke shaft is preferably supported so as to be moveable to a limited extent relative to the choke adjusting lever. In this way, the choke valve can be moved into its open position even though the actuator switch is still in its emergency stop position. According to a first embodiment it is advantageous that the release device for releasing the choke adjusting lever is slidable axially on the choke shaft against the force of a spring. By this movement, the choke adjusting lever is moved into another plane relative to the throttle adjusting lever so that the locking action is released.

According to a second embodiment, the choke adjusting lever is pivotably supported on the choke shaft and the device is formed by an actuating rod that generates the tilting movement. For this purpose, the choke adjusting lever is supported advantageously on a transverse pin that projects through the choke shaft. In the choke adjusting lever there is expediently an elongate opening into which one end of the choke shaft projects; between the contour of the opening and the end of the choke shaft a spacing is provided that enables a defined tilting angle.

According to an expedient embodiment, a coil spring is provided that is concentrically arranged relative to the choke shaft and loads the choke adjusting lever in the rotary direction and in the axial direction. In this way, the coil spring fulfills two functions, i.e., restoring the choke valve into its open position and restoring the choke adjusting lever into the plane for interaction with the throttle adjusting lever. In the first embodiment, the release device comprises in an expedient way a choke control lever that may be coupled mechanically with the choke adjusting lever. The choke control lever is secured on the choke shaft but is freely rotatable relative thereto at least in one direction. This choke control lever comprises at least one follower that engages a cutout in the choke adjusting lever. In this connection, the follower is designed such that the choke control lever acts on the choke adjusting lever when the choke valve is to be closed.

For producing the axial movement of the choke adjusting lever it is expedient that the choke control lever comprises at least one ramp that interacts with the choke adjusting lever in the axial direction. It is moreover advantageous that two followers are arranged on the choke control lever, preferably diametrically opposed relative to the choke shaft, and on each one of the followers a ramp is provided. In this way, the forces can be uniformly distributed and jamming of the choke control lever is prevented. In order to reduce the actuating forces, it is expedient that on the choke adjusting lever slanted surfaces are formed that have the same slant angle as the ramps. It is moreover expedient that on the choke adjusting lever a projection is provided that serves as a stop for the follower in the closing direction of the choke valve.

DESCRIPTION OF THE PREFERRED EMBODIMENTS

Figure 1:
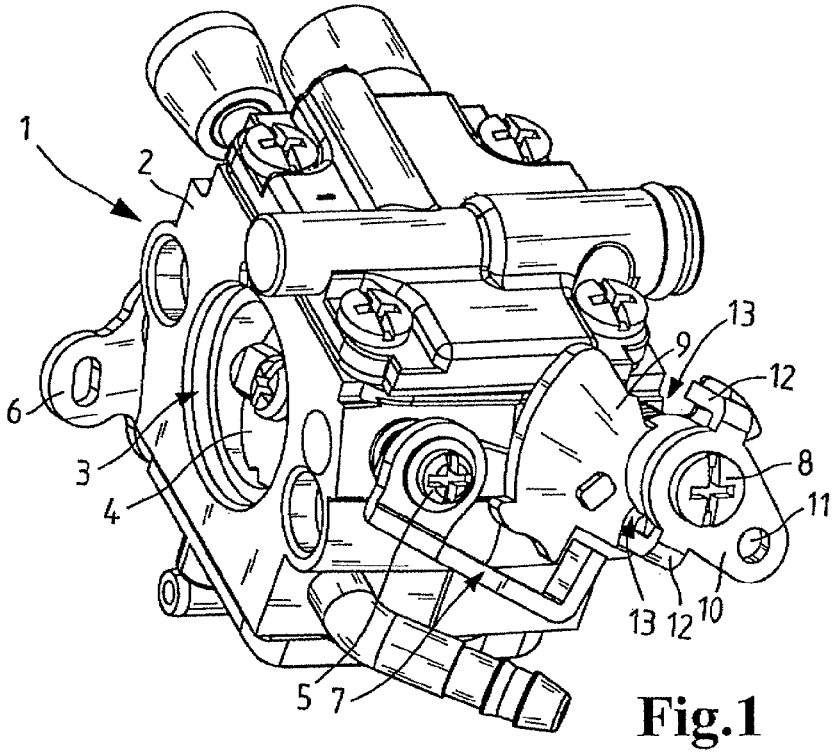
FIG. 1 is a perspective view of a first embodiment of the carburetor.

FIG. 1 shows a carburetor 1 for an internal combustion engine, for example, in a power tool. The carburetor 1 comprises a carburetor housing 2 with a mixture forming passage 3 extending therein as well as a throttle valve 4 and a choke valve, not shown in FIG. 1. The throttle valve 4 is attached to a rotatably supported throttle shaft 5 that is provided, at an end that projects from the housing 2, with an actuator lever 6 and, at the other end projecting from the housing 2, is provided with a throttle adjusting lever 7. To the actuator lever 6 a throttle linkage or a throttle cable is connected in order to adjust the throttle valve 4 by rotating the throttle shaft 5. This rotary movement is also performed by the throttle adjusting lever 7 that is connected to the throttle shaft 5.

Transversely to the mixture forming passage 3 in the carburetor housing 2 a choke shaft 8 is arranged on which the choke valve, not shown in FIG. 1, is mounted. On the end of the choke shaft 8 which projects from the carburetor housing 2, a choke adjusting lever 9 is arranged that is connected to the choke shaft 8 such that it rotates with it but is axially slidable on it. Moreover, on this end of the choke shaft 8 a choke control lever 10 is arranged which is rotatable relative to the choke shaft 8 and the choke adjusting lever 9. The choke control lever 10 has an opening 11 that is engaged by a control rod that is actuatable by an operating switch. The choke control lever 10 has two followers 12 extending parallel to the choke shaft 8 that engage recesses 13 of the choke adjusting lever 9.

Figure 2:
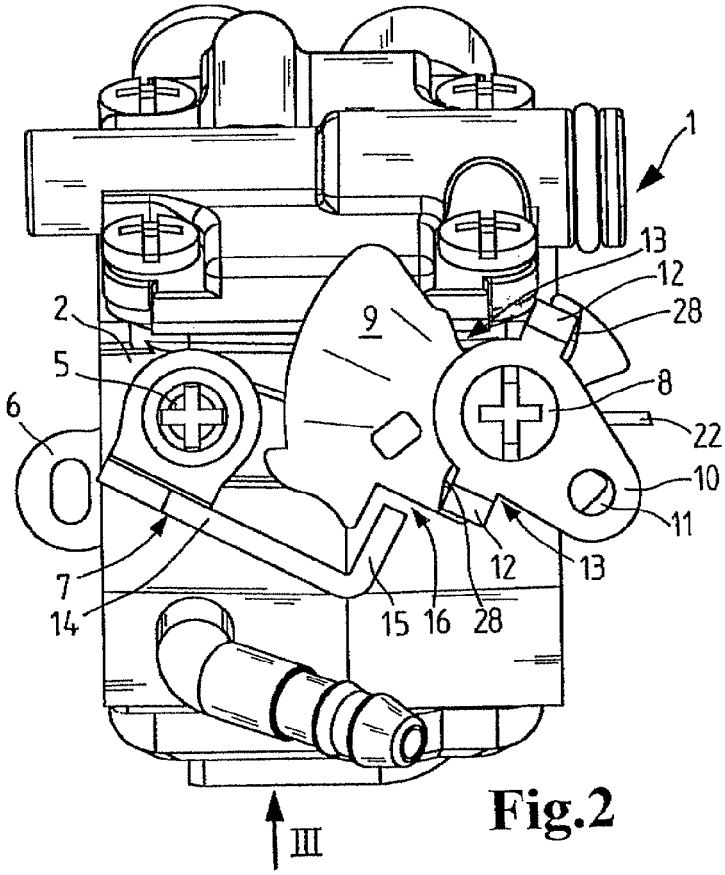
FIG. 2 is a view of the carburetor in the direction of a lever arrangement for a throttle valve and a choke valve in a stop position.

In FIG. 2 the carburetor 1 is shown in a view onto the lever arrangement for the throttle valve and the choke valve in a stop position. FIG. 2 shows the actuator lever 6 projecting on the left side from behind the carburetor housing 2. On the end of the throttle shaft 5 the throttle adjusting lever 7 is positioned and comprises an arm 14 that extends parallel to a tangent of the throttle shaft 5 and comprises a leg 15 that is bent at a right angle toward the choke adjusting lever 9. In this stop position the leg 15 engages a cutout 16 at the edge of the choke adjusting lever 9. In this position of the choke adjusting lever 9, the choke valve 22 that projects on the right side of the carburetor housing 2 from the mixture forming passage is in completely open position. The choke control lever 10 engages with its followers 12 the recesses 13 of the choke adjusting lever 9; in this position, the followers 12 engage edges 28 of the choke adjusting lever 9. The positions of the throttle adjusting lever 7 and of the choke adjusting lever 9 in FIG. 2 are assumed as a result of the restoring springs acting on these levers. The position of the choke control lever 10 is determined by the afore mentioned control rod and the operating switch of the power tool.

Figure 3:
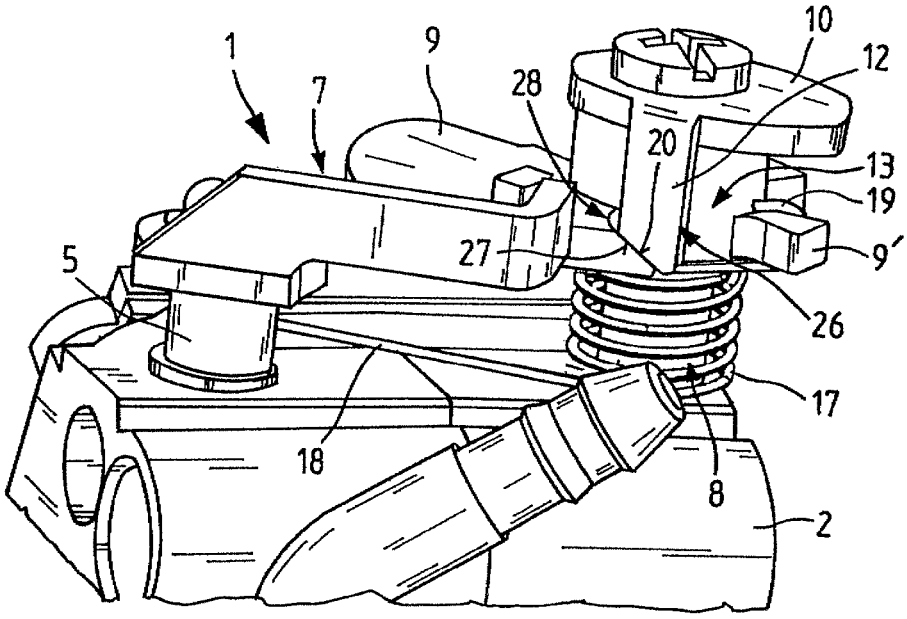
FIG. 3 is a detail illustration of a portion of the carburetor substantially in the direction of arrow III in FIG. 2.

FIG. 3 shows a detail illustration of a portion of the carburetor 1 substantially in the direction of arrow III of FIG. 2. The throttle shaft 5 projects from the carburetor housing 2 and on its end the throttle adjusting lever 7 is attached. Moreover, the choke shaft 8 projecting from the carburetor housing 2 can be seen on which the choke control lever 10 and the choke adjusting lever 9 are mounted. Concentrically to the choke shaft 8 a coil spring 17 is arranged whose one end has a leg 18 which engages behind the throttle shaft 5 and whose other end is bent to a hook 19 that is hooked onto a projection 9' of the choke adjusting lever 9. The coil spring 17 thus has the function to return the choke adjusting lever 9 and thus also the choke valve into the position in which the mixture forming passage is completely open. In addition, the coil spring 17 acts as pressure spring because it is supported with one end on the carburetor housing 2 and with the other end on the choke adjusting lever 9 and therefore forces the choke adjusting lever 9 against the choke control lever 10.

The followers 12 on the choke control lever 10 project into the recesses 13 of the choke adjusting lever 9; FIG. 3 shows that the followers 12 have on one side a ramp 20 that rests against a slanted surface 27 of the edge 28. On the other side the follower 12 has a contour 26 that extends at a right angle relative to the choke adjusting lever 9. With this configuration it is possible that in the clockwise rotary direction of the choke control lever 10 the ramp 20 glides on slanted surface 27 and when doing so pushes the choke adjusting lever 9 against the force of the coil spring 17 downwardly, i.e., in axial direction of the choke shaft 8.

In the counterclockwise rotary direction of the choke control lever 10, the follower 12 with its contour 26 rests against the projection 9' and entrains in this way the choke adjusting lever 9 so that the choke valve is adjusted in the direction of closing of the mixture forming passage. The other follower of the choke control lever 10 that is not visible in FIG. 3 is designed in the same way; this holds true also for the other slanted surface 27 on the choke adjusting lever 9.

Figure 4:
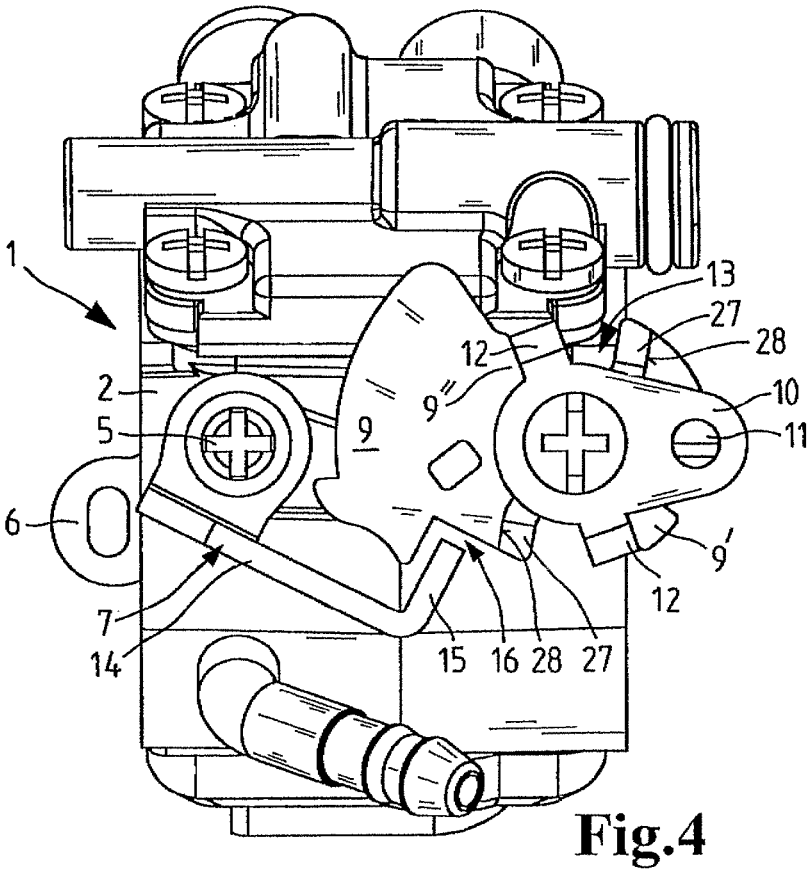
FIG. 4 is a view according to FIG. 2 with the lever arrangement in idle position.
Figure 5:
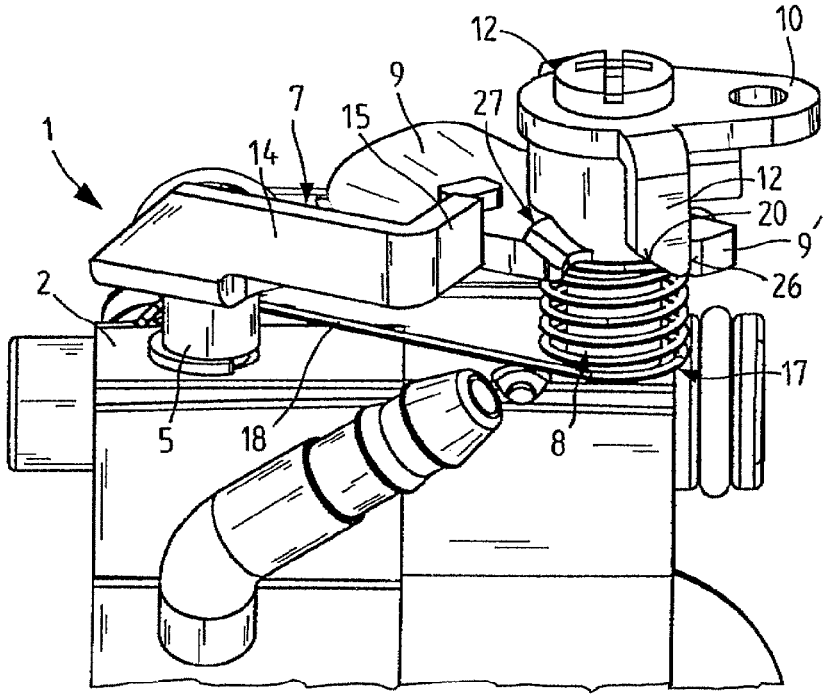
FIG. 5 is a view in a similar perspective as in FIG. 3 showing the idle position.

FIG. 4 shows a view of the carburetor 1 according to FIG. 2; FIG. 5 shows a view according to FIG. 3, each Figure showing the lever arrangement in idle position. This idle position differs from the starting position illustrated in FIGS. 2 and 3 by the changed position of the choke control lever 10 because lever 10 is now positioned with contour 26 of its followers 12 on corresponding radial projections 9', 9" of the choke adjusting lever 9. In idle position, in contrast to the stop position, the ignition of the internal combustion engine is switched on. FIG. 5 illustrates that the throttle adjusting lever 7 and the choke adjusting lever 9 are in a common engagement plane. FIG. 4 shows that on the choke adjusting lever 9 two slanted surfaces 27 are provided diametrically opposed to one another relative the axis of rotation of the choke shaft 8. In other respects, the reference numerals in FIGS. 4 and 5 for same parts are the same as those of FIGS. 2 and 3.

Figure 6:
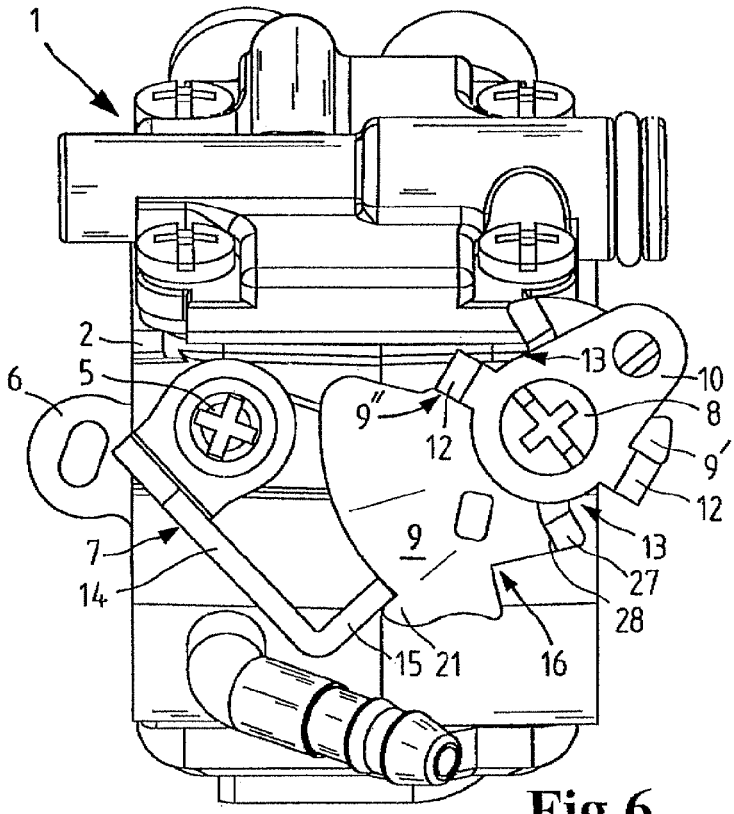
FIG. 6 is a view according to FIG. 2 showing the starting position of the lever arrangement.

FIG. 6 shows a view of the carburetor 1 in a starting position of the lever arrangement. In order to reach this starting position, by means of the already mentioned operating switch the throttle cable that is connected to the actuator lever 6 and the control rod that is attached to the choke control lever 10 are moved such that the actuator lever 6 together with the throttle valve is rotated about an angle in the clockwise direction and the choke control lever 10 with the choke adjusting lever 9 are pivoted about an angle in counterclockwise direction. The movement of the throttle adjusting lever 7 causes the arm 14 to be moved by the choke adjusting lever 9 and the leg 15 is pivoted far enough away from the cutout 16 in order to enable rotation of the choke adjusting lever 9. The control rod moves the choke control lever 10 in counterclockwise direction so that the choke adjusting lever 9 is entrained wherein the rotary angle is sufficient in order for the leg 15 to catch behind the locking nose 21 provided on the circumference of the choke adjusting lever 9 and to rest against the choke adjusting lever 9. In this way, the choke valve is now in the starting position, i.e., it releases partially the cross-section of the mixture forming passage.

Figure 7:
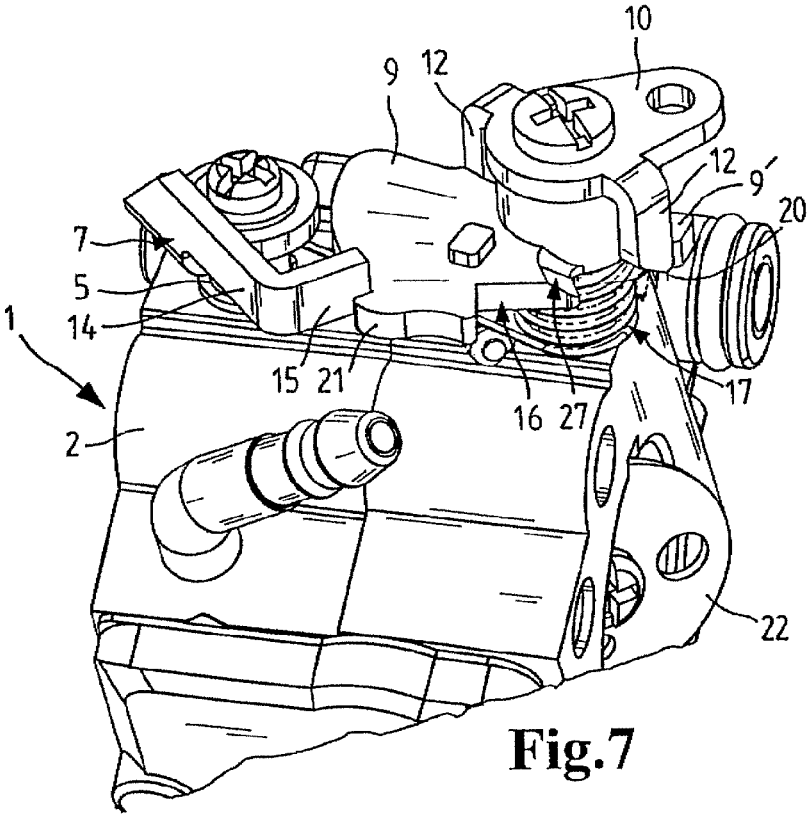
FIG. 7 is a forwardly tilted perspective view of the portion of the carburetor according to FIG. 3 in the starting position.

FIG. 7 shows a detail of the carburetor 1 similar to the view of FIG. 3. This illustration also shows the choke valve 22 projecting from the carburetor housing 2. The leg 15 of the throttle adjusting lever 7 catches behind the locking nose 21 so that the choke adjusting lever 9 and the choke control lever 10 are prevented from returning into the rest position as a result of the action of the coil spring 17. In other respects, for same parts the same reference numerals as in FIG. 6 are used.

Figure 8:
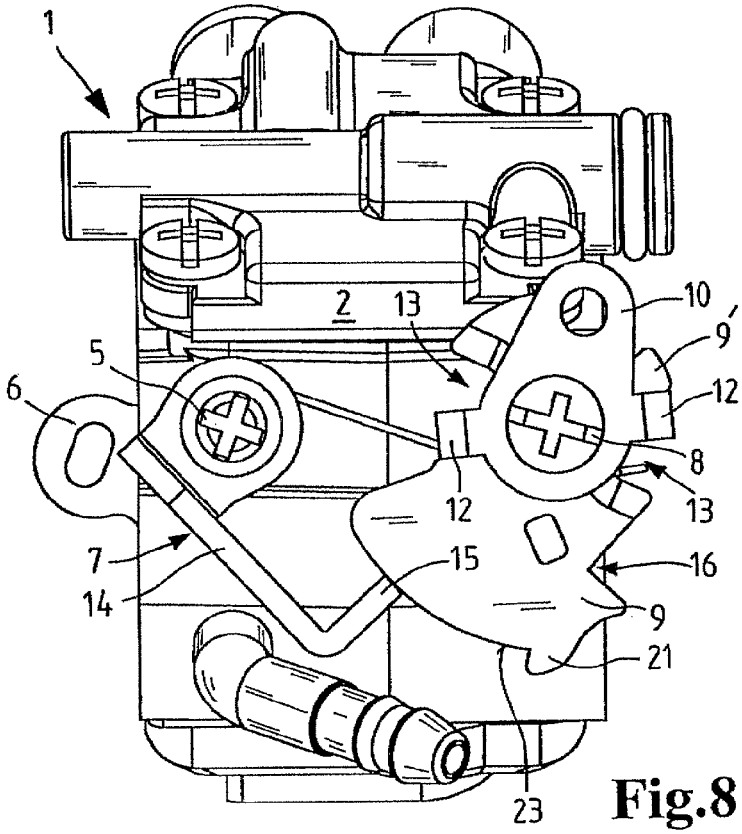
FIG. 8 is a view according to FIG. 2 showing a choke position.

FIG. 8 shows a view of the carburetor 1 in a choke position of the lever arrangement. In this position, the choke control lever 10 and the choke adjusting lever 9 are farther rotated in counterclockwise direction so that the choke valve is moved into its closed position. The throttle adjusting lever 7 remains unchanged because the leg 15 is supported on an arched edge 23 (FIG. 9) that is curved about the axis of rotation of the choke adjusting lever 9. The reference numerals in FIGS. 8 and 9 are the same for same parts as in the preceding Figures.

Figure 9:
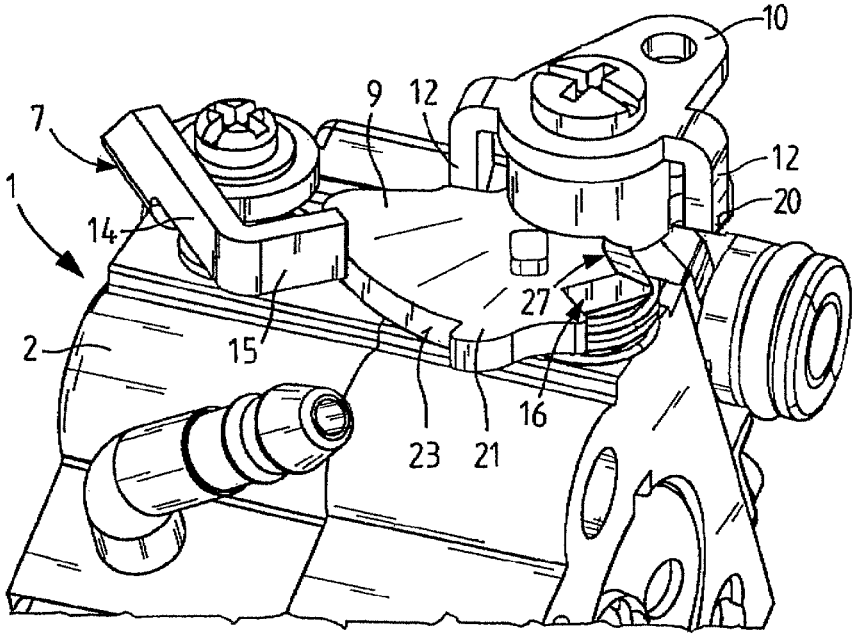
FIG. 9 is a perspective view similar to FIG. 7, but rotated somewhat about the vertical axis of the carburetor, in the choke position.

In FIG. 9, a detail of the carburetor in the choke position of the lever arrangement is illustrated wherein the arched edge 23 on which the leg 15 is supported is visible. In this position of the valves in the carburetor 1 the internal combustion engine can be started wherein, after the engine has started, upon first actuation of the accelerator by the operator the throttle adjusting lever 7 is pivoted in the clockwise direction and in this way the choke adjusting lever 9 and the choke valve are returned by the coil spring in clockwise direction into the initial position.

Figure 10:
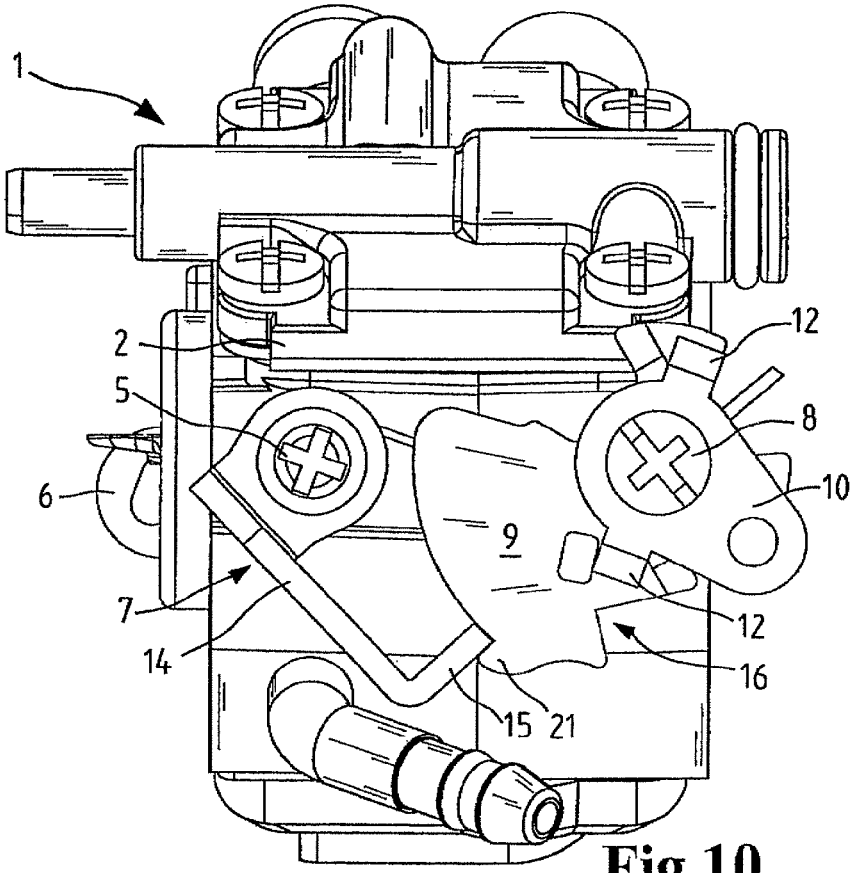
FIG. 10 is a view according to FIG. 2 in an intermediate position of the movement of the levers after activation of the operating switch into an emergency stop position.
Figure 11:
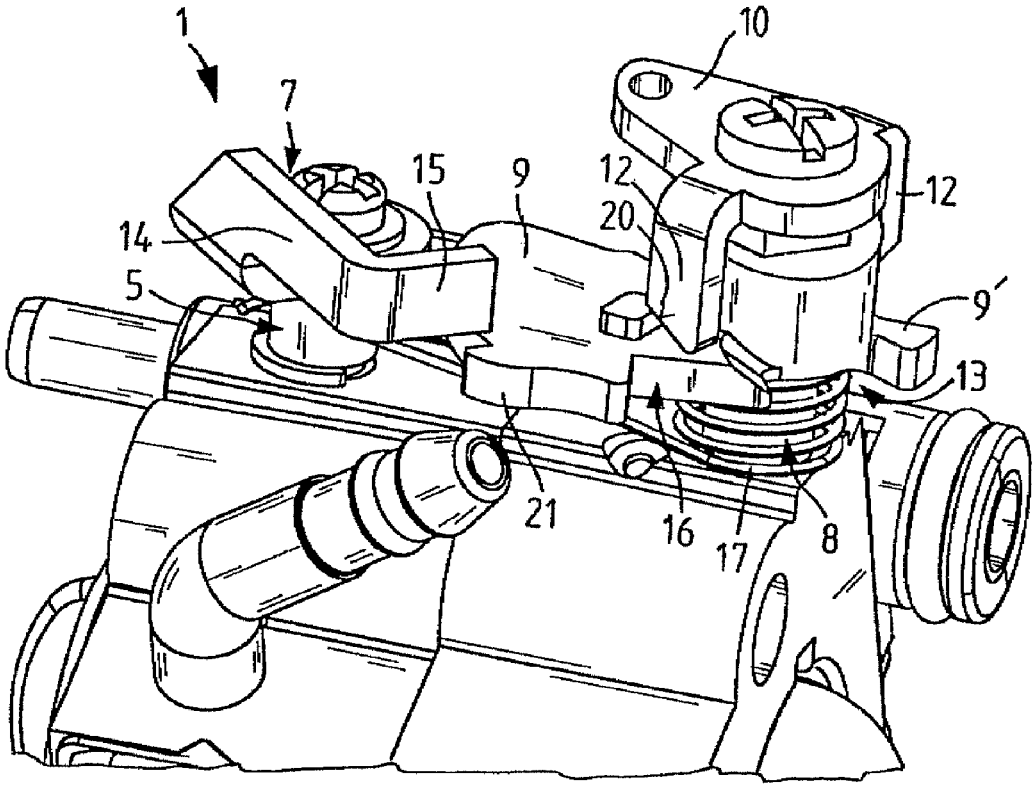
FIG. 11 is a detail of the carburetor in perspective illustration with the lever arrangement in the intermediate position according to FIG. 10.

FIG. 10 shows the carburetor 1 in a view onto the lever arrangement in an intermediate position of the levers during their movement after actuation of the operating switch into the emergency stop position. When for the operating switch of the power tool the emergency stop position is selected while the lever arrangement on the carburetor 1 is still in the starting position, the actuating rod moves the choke control lever 10 in clockwise direction. By doing so, the ramps 20 of the followers 12 slide along the slanted surfaces 27 of the choke adjusting lever 9 (compare FIG. 3) which causes the choke adjusting lever 9 to move in axial direction of the choke shaft 8 against the force of the coil spring 17. The followers 12 are then supported on the surface of the choke adjusting lever 9 as shown in FIG. 11. This axial displacement of the choke adjusting lever 9 is sufficient in order to move the choke adjusting lever 9 into a plane below the throttle adjusting lever 7 and to thus cancel or release the locking action of the leg 15 on the locking nose 21, as shown in FIG. 11. The coil spring 17 ensures that the choke adjusting lever 9 and the choke valve are returned into the basic position. Since the leg 15 is now again in the area of the cutout 16 and the followers 12 in the area of the recesses 13, the choke adjusting lever 9 is forced by the coil spring 17 in the axial action of the choke shaft 8 against the choke control lever 10.

Figure 12:
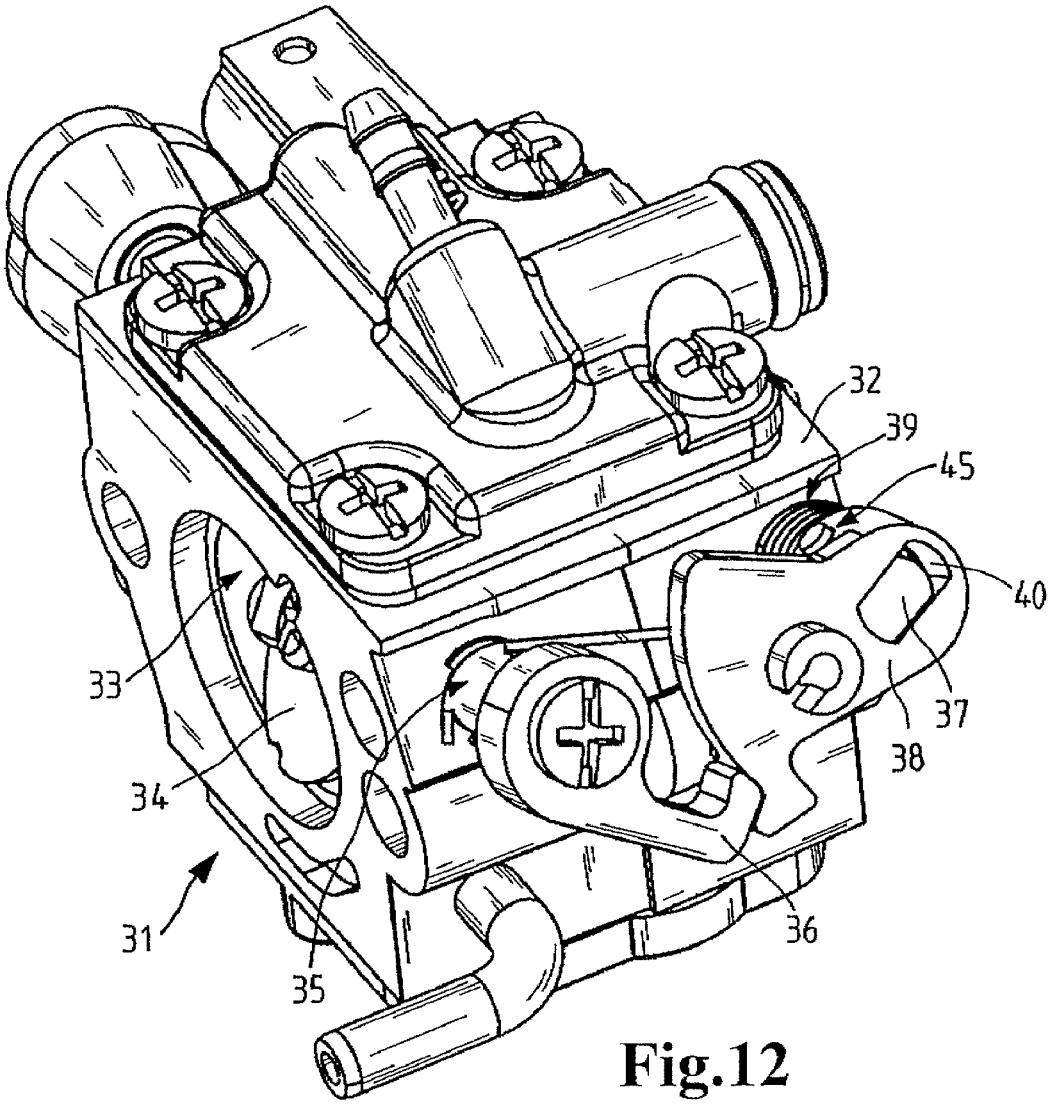
FIG. 12 is a perspective view of a second embodiment of the carburetor.

FIG. 12 shows a second embodiment of a carburetor 31 that comprises a housing 32 with a mixture forming passage 33 arranged therein as well as a throttle valve 34 and choke valve (not visible in FIG. 12). The throttle valve is attached on a rotatably supported throttle shaft 35 which is provided on an end that is projecting from the housing 32 with a throttle adjusting lever 36. Transversely to the mixture forming passage 33 in the carburetor housing 32 a choke shaft is arranged of which only one end 37 is visible in FIG. 12. A choke adjusting lever 38 is arranged on the choke shaft which in the illustration according to FIG. 12 is located in a common engagement plane with the throttle adjusting lever 36. For attaching the choke adjusting lever 38 on the choke shaft a transverse pin 45 is provided on which the choke adjusting lever 38 is pivotably supported about the axis of the transverse pin 45.

Between the housing 32 and the choke adjusting lever 38 concentrically on the choke shaft a coil spring 39 is provided that serves for returning the choke valve into its completely open position as well as for loading the choke adjusting lever in the direction toward the engagement plane. In the choke adjusting lever 38 an elongate opening 40 is provided into which the end 37 of the choke shaft projects. The end 37 is designed with respect to its cross-section such that only in longitudinal direction of the opening 40 and thus at a right angle to the longitudinal axis of the transverse pin 45 a relative movement is possible. The positions of the throttle adjusting lever 36 and the choke adjusting lever 38 in FIG. 12 corresponds to the starting position illustrated in FIG. 6.

Figure 13:
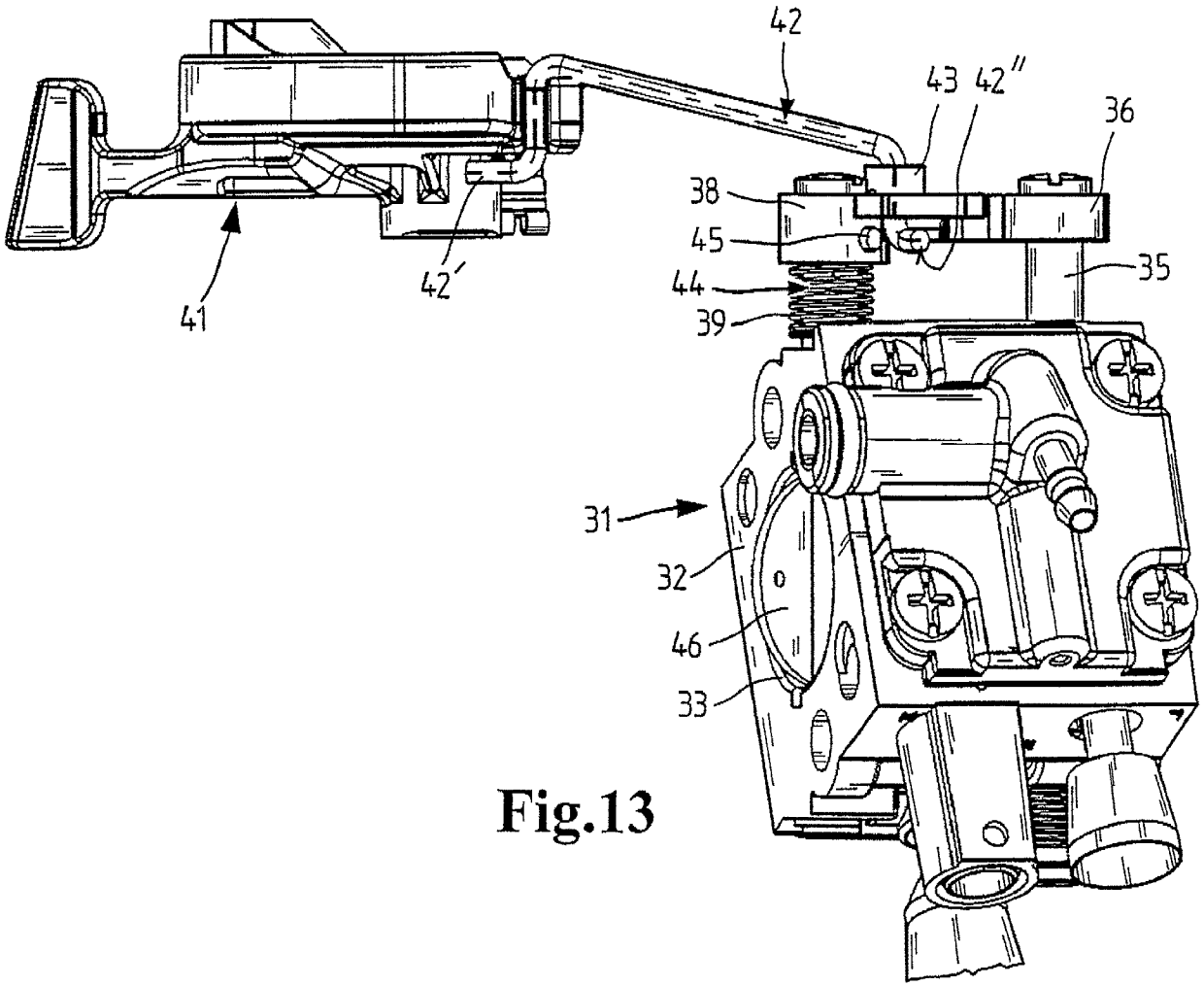
FIG. 13 is another view of the carburetor of FIG. 12 with an operating switch and an operating rod.

In FIG. 13 the carburetor 31 according to FIG. 12 is shown in a different view wherein in addition also an actuating switch 41 and actuating rod 42 are illustrated. The actuating rod 42 is connected with one end 42' to the actuating switch 41 and the end 42" is hooked into an appropriate receptacle 43 on the choke adjusting lever 38. As a function of the position that is adjusted by means of the operating switch 41, the choke adjusting lever 38 is adjusted also, for example, into the starting position illustrated in FIG. 12. The throttle adjusting lever 36 mounted on the throttle shaft 35 and the choke adjusting lever 38 mounted on choke shaft 44 are in the common engagement plane in which an interaction of the levers is enabled. The choke adjusting lever 38 is attached by means of transverse pin 45 on the choke shaft 44 wherein the coil spring 39 forces the choke adjusting lever 38 into the engagement plane. FIG. 13 also shows a choke valve 46 located within the mixture forming passage 33.

Figure 14:
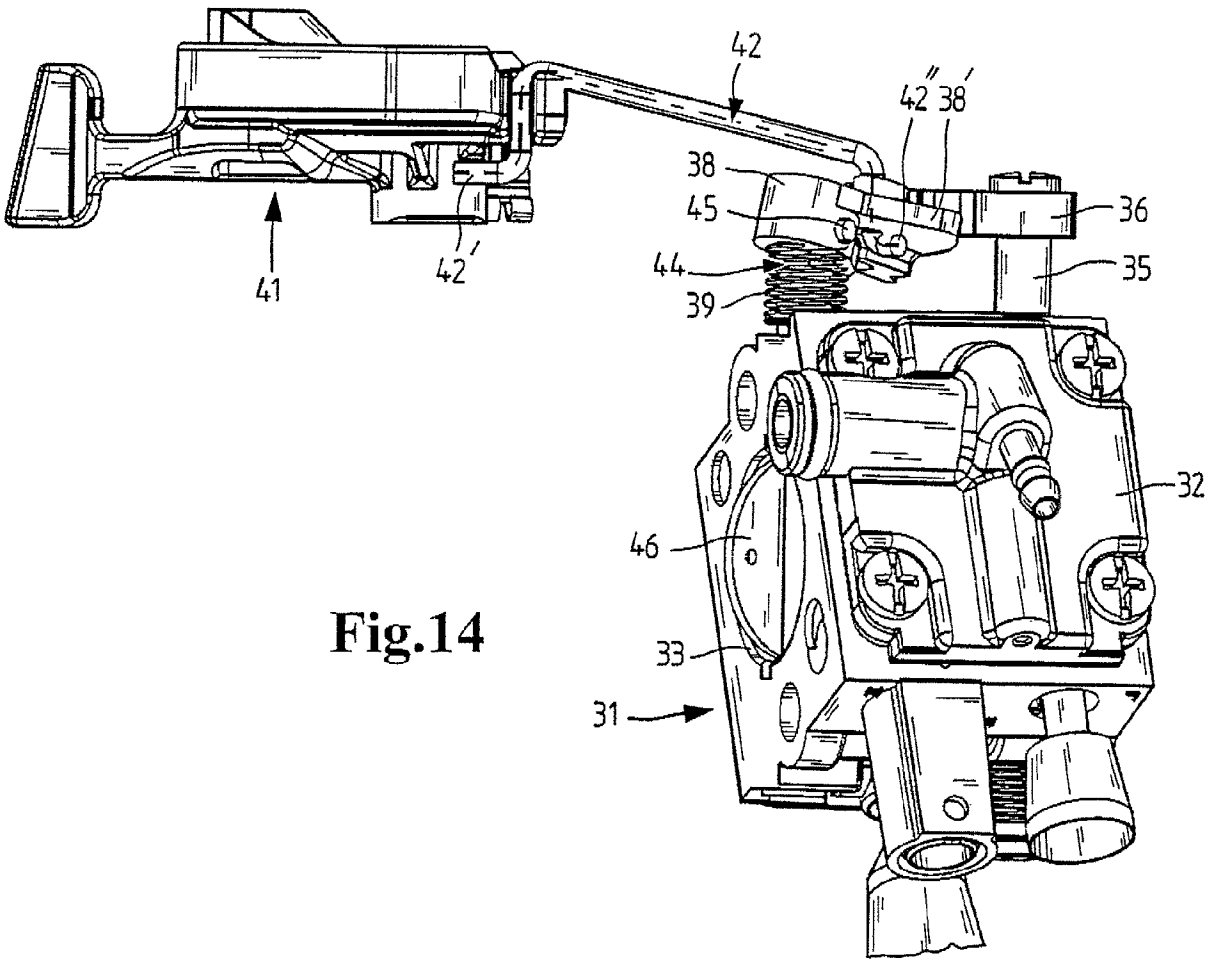
FIG. 14 is an illustration according to FIG. 13 during the triggering movement.

Moving the operating switch 41 into the emergency stop position causes the movement of the actuating rod such that the end 42" presses against the choke adjusting lever 38. Since the point of force introduction is outside of the axis of the transverse pin 45, the choke adjusting lever 38 is pivoted about this axis and the end 38' of the choke adjusting lever 38 facing the throttle adjusting lever 36 is lowered against the force of the coil spring 39. In FIG. 14 a position during the described release procedure is illustrated. In other respects, for same parts the same reference numerals as in FIGS. 12 and 13 are used.

Figure 15:
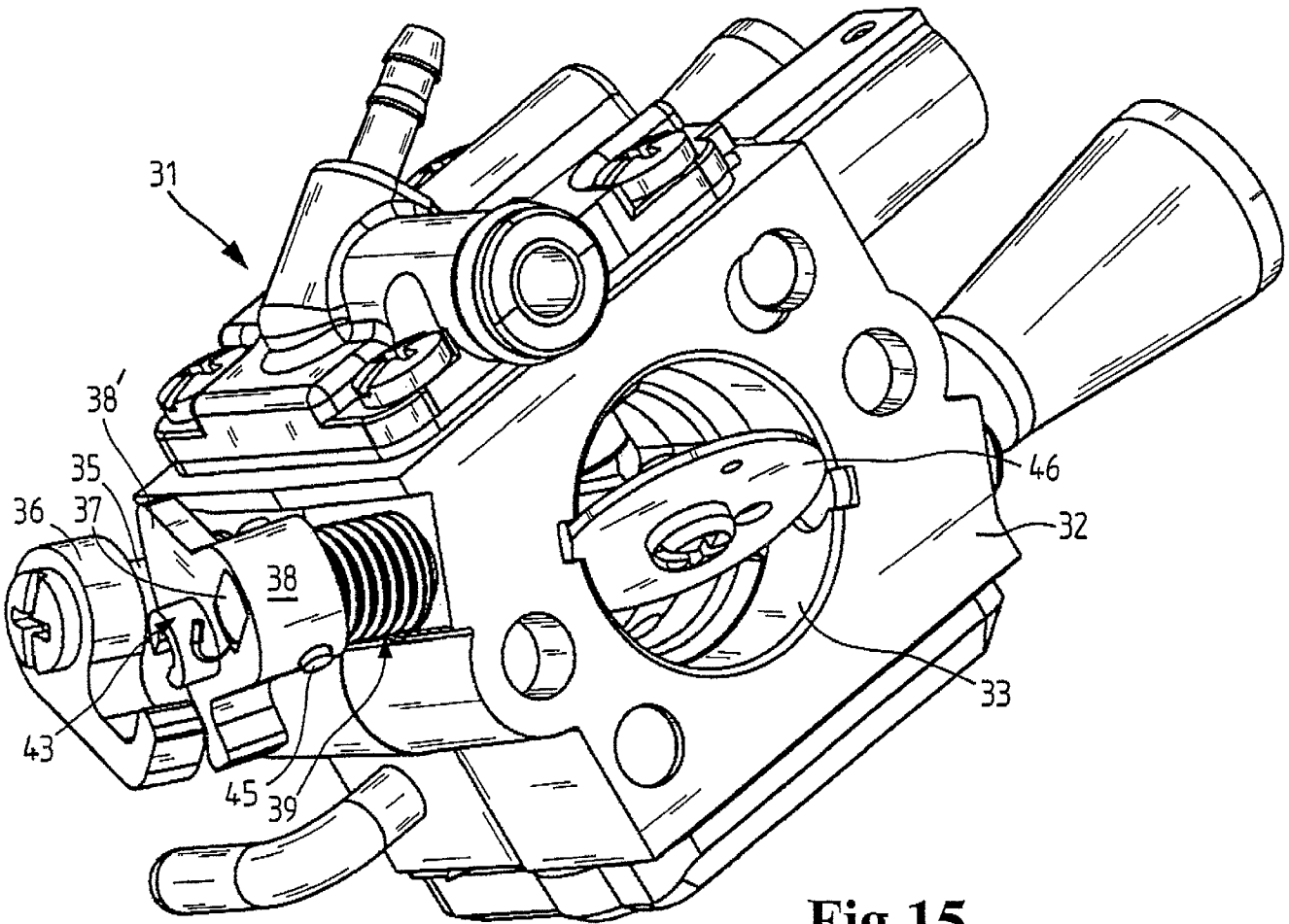
FIG. 15 is a modified view of the carburetor according to FIG. 12 showing the levers in the released position.

FIG. 15 shows a modified view of the carburetor 31 according to FIG. 12 in the released state of throttle adjusting lever 36 and choke adjusting lever 38. In this connection, the choke adjusting lever 38 is pivoted about the axis of the transverse pin 45 so that the end 38' of the choke adjusting lever 38 is lowered to a position below the lower edge of the throttle adjusting lever 36 and the mutual engagement is thus canceled. The coil spring 39 then returns the choke adjusting lever 38 and the choke valve 46 into the initial position in which the choke valve 46 completely opens the mixture forming passage 33. Moreover, the coil spring 39 pushes the side of the choke adjusting lever 38 where the end 38' is located upwardly so that the choke adjusting lever 38 is positioned again in the engagement plane. In other respects, for same parts the same reference numerals as those in FIGS. 12 to 14 are used.

The specification incorporates by reference the entire disclosure of German priority document 10 2009 014 362.9 having a filing date of Mar. 21, 2009.

While specific embodiments of the invention have been shown and described in detail to illustrate the inventive principles, it will be understood that the invention may be embodied otherwise without departing from such principles.

What is claimed is:

1. A carburetor for an internal combustion engine, the carburetor comprising:

a carburetor housing;

a mixture forming passage provided in said carburetor housing;

a throttle valve rotatably arranged in said mixture forming passage on a throttle shaft;

a choke valve rotatably arranged in said mixture forming passage on a choke shaft;

a lever arrangement comprising a throttle adjusting lever mounted on said throttle shaft and a choke adjusting lever mounted on said choke shaft;

wherein said throttle valve and said choke valve are adjustable in several operating positions and wherein said lever arrangement assumes appropriate positions corresponding to said operating positions, respectively;

a release device for releasing a locking action between said throttle adjusting lever and said choke adjusting lever when an emergency stop is actuated;

a spring forcing said choke adjusting lever in a direction toward an engagement plane with said throttle adjusting lever.

2. The carburetor according to claim 1, wherein said choke adjusting lever is fixedly connected to said choke shaft for common rotation with said choke shaft and wherein said spring loads said choke valve additionally in a direction of an open position.

3. The carburetor according to claim 1, wherein said release device is supported on said choke shaft so as to be movable relative to said choke adjusting lever to a limited extent.

4. The carburetor according to claim 1, wherein said release device for releasing said locking action moves said choke adjusting lever against a force of said spring axially on said choke shaft.

5. The carburetor according to claim 1, wherein said choke adjusting lever is pivotably supported on said choke shaft and wherein said release device comprises an actuating rod that causes a tilting movement of said choke adjusting lever.

6. The carburetor according to claim 5, comprising a transverse pin arranged in said choke shaft, wherein said choke adjusting lever is supported so as to be tiltable on said transverse pin.

7. The carburetor according to claim 6, wherein an opening is provided in said choke adjusting lever and wherein one end of said choke shaft projects into said opening, wherein between a contour of said opening and said end of said choke shaft a spacing is provided that enables a defined tilting angle for said choke adjusting lever on said transverse pin.

8. The carburetor according to claim 1, wherein said spring is a coil spring that is arranged concentrically to said choke shaft and loads said choke adjusting lever in a rotational direction and in an axial direction.

9. The carburetor according to claim 1, wherein said release device has a choke control lever that is adapted to be coupled mechanically to said choke adjusting lever.

10. The carburetor according to claim 9, wherein said choke control lever has at least one follower that engages a recess of said choke adjusting lever.

11. The carburetor according to claim 10, wherein on said choke adjusting lever at least one projection is provided that serves as a stop for said at least one follower in a closing direction of said choke valve.

12. The carburetor according to claim 9, wherein said choke control lever comprises at least one ramp that interacts with said choke adjusting lever in an axial direction.

13. The carburetor according to claim 9, wherein said choke control lever has two followers that each engage a recess of said choke adjusting lever, wherein said followers each have a ramp that interacts with said choke adjusting lever in an axial direction.

14. The carburetor according to claim 13, wherein on said choke adjusting lever slanted surfaces are formed that have a slant angle that is identical to a slant angle of said ramps.

15. The carburetor according to claim 13, wherein on said choke adjusting lever projections are provided that serve as a stop for said followers in a closing direction of said choke valve.

* * * * *